United States Patent [19]

Snyder, Jr.

[11] 4,292,751

[45] Oct. 6, 1981

[54] ROLL TYPE DISPLAY SIGN

[75] Inventor: H. Kent Snyder, Jr., River Forest, Ill.

[73] Assignee: Chicago Display Company, Chicago, Ill.

[21] Appl. No.: 146,226

[22] Filed: May 5, 1980

[51] Int. Cl.[3] ..... G09F 11/18; G09F 23/00; G09F 17/00

[52] U.S. Cl. ..... 40/517; 40/609; 40/604

[58] Field of Search ..... 40/517, 514, 515, 518, 40/520, 603, 604, 609

[56] References Cited

U.S. PATENT DOCUMENTS

| | | | |
|---|---|---|---|
| 384,253 | 6/1886 | Hall | 40/517 X |
| 396,463 | 1/1889 | Bullard | 160/23 |
| 464,030 | 12/1891 | Ludgin | 40/517 |
| 843,837 | 2/1907 | McMaster | 40/517 |
| 1,081,644 | 12/1913 | Wilson | 40/517 X |
| 1,136,575 | 4/1915 | Wohlcke et al. | 40/517 X |
| 1,298,739 | 4/1919 | Langford | 40/517 X |
| 1,364,223 | 1/1921 | Venard | 40/517 |
| 1,427,038 | 8/1922 | Toadvine | 40/517 X |
| 2,188,612 | 1/1940 | Owen et al. | 40/517 X |
| 3,430,374 | 3/1969 | Woodard | 40/591 |
| 3,462,867 | 8/1969 | Pinkman et al. | 40/517 |
| 3,949,503 | 4/1976 | Waress | 40/591 |

*Primary Examiner*—Gene Mancene
*Assistant Examiner*—Michael J. Foycik
*Attorney, Agent, or Firm*—Hume, Clement, Brinks, Willian & Olds, Ltd.

[57] ABSTRACT

A roll type display sign for a pump is disclosed having an upper bracket mounted to slide across an upper edge of a frame surrounding a pump face. A spring biased roller is mounted to the upper bracket and a display sheet is mounted to the roller such that the sheet is movable between a retracted position, in which the display sheet is wrapped around the roller, and an extended position, in which the display sheet extends across and substantially parallel to a portion of the pump face. The sign also includes a lower bracket mounted to a lower frame edge. This lower bracket is provided with three hooks spaced across the length of the lower edge which engage a loop member mounted to a cross bar attached to an edge of the display sheet. By sliding the upper bracket into an appropriate position and hooking the loop defining member about an appropriate one of the three hooks, the display sheet can be positioned over any one of three portions of the pump face.

13 Claims, 8 Drawing Figures

FIG. 1
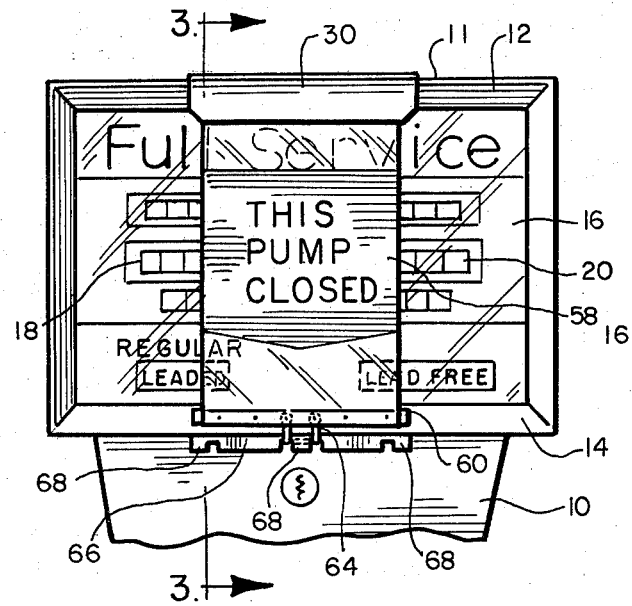
FIG. 2
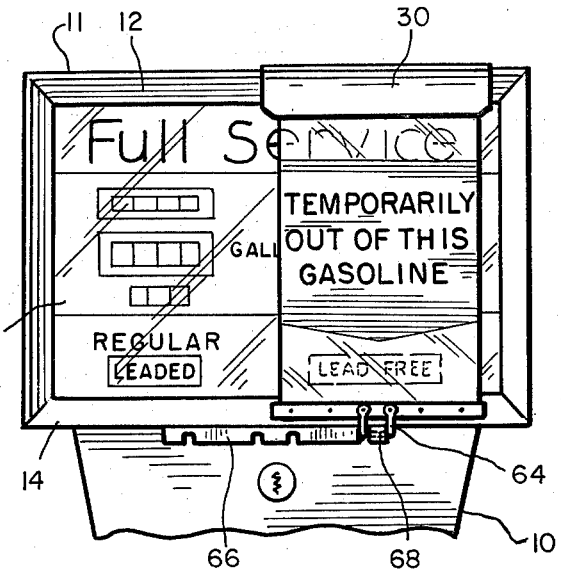
FIG. 3
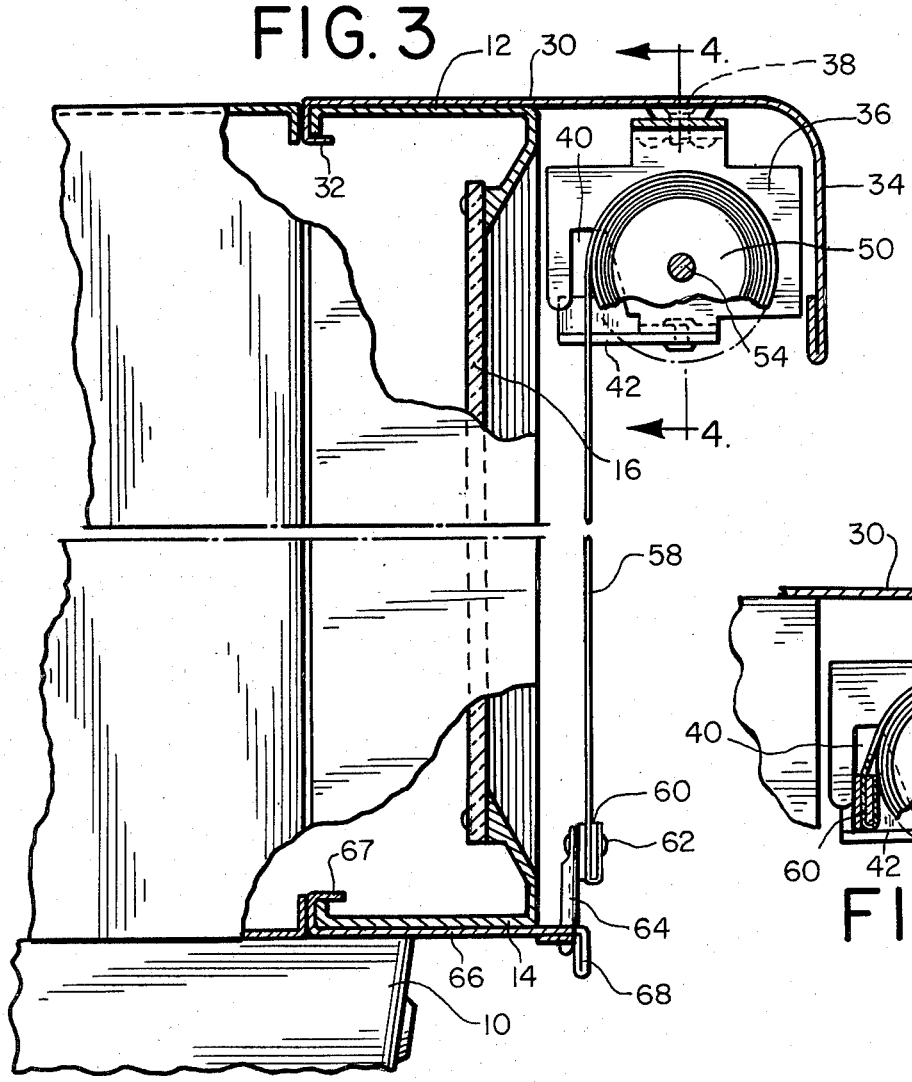
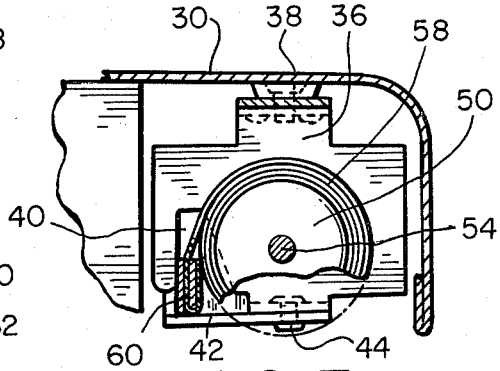
FIG. 3a

ROLL TYPE DISPLAY SIGN

BACKGROUND OF THE INVENTION

The present invention is directed to an improved roll type display sign for use with dispensing pumps such as gasoline pumps.

Typically, filling stations which dispense and sell automotic fuels, such as gasoline and diesel fuel, include a number of separate dispensing pumps. For example, pumps are often provided to dispense leaded fuel and unleaded fuel, in both regular and high octane grades. Under some situations it may be necessary to close one or more of these pumps while maintaining the other pumps in operation. For example, breakdown of pumps or during times of fuel shortage, leaded fuels may be in short supply while unleaded fuels are available. Under these circumstances, it is necessary to indicate clearly to the purchasing public which pumps are open for service and which are closed.

In the past, many filling stations have not been provided with commercially acceptable means for indicating which pumps are open and which are closed. Left to their own devices, station managers have often used handwritten signs and other ad hoc measures. Such ad hoc measures can create an adverse impression on the purchasing public.

SUMMARY OF THE INVENTION

The present invention is directed to an improved roll type sign which conveniently stores out of the way when not in use and which can be easily extended over the face of a pump to indicate that a pump is out of service.

According to this invention, a roll type display sign is provided which attaches to a pump frame surrounding a pump face. This display sign includes a first bracket adapted to fit around an edge of a frame, a shaft mounted message bearing display sheet mounted to the first bracket, and a second bracket adapted for mounting to a second edge of the frame. Means are included for releasably securing the display sheet to the second bracket to hold the display sheet in an extended position in which the display sheet simultaneously covers a portion of the pump face and displays a message on the display sheet.

Preferably, the display sheet is spring biased into a retracted position in which it is wrapped around the shaft out of sight in the first bracket. Additionally, the first bracket can be slidably mounted to the frame such that it is movable across the face of the pump between a left position, a center position and a right position. In this embodiment, the second bracket is provided with three attachment points, and the display sheet can easily be positioned over either the left half, the right half, or the center of the pump face. In this way, a single roll type display sign can be used on a pump bearing two individual dispensing stations to indicate either that the left dispensing station is out of service, that the right dispensing station is out of service, or that both dispensing stations are out of service.

The invention, together with further objects and attendant advantages, will be best understood by reference to the following detailed description taken in conjunction with the accompanying drawings.

BRIEF DESCRIPTION OF THE DRAWINGS

FIG. 1 is a front view of a dispensing pump including a preferred embodiment of the display sign of this invention positioned over a central portion of the pump face.

FIG. 2 is a front view of the embodiment of FIG. 1 showing the embodiment positioned over a right hand portion of the pump face.

FIG. 3 is a cross-sectional view taken along line 3—3 of FIG. 1 showing the display sheet in the extended position.

FIG. 3*a* is a partial cross-sectional view corresponding to the view of FIG. 3 showing the display sheet in the retracted position.

DETAILED DESCRIPTION OF A PREFERRED EMBODIMENT

Figure 4:
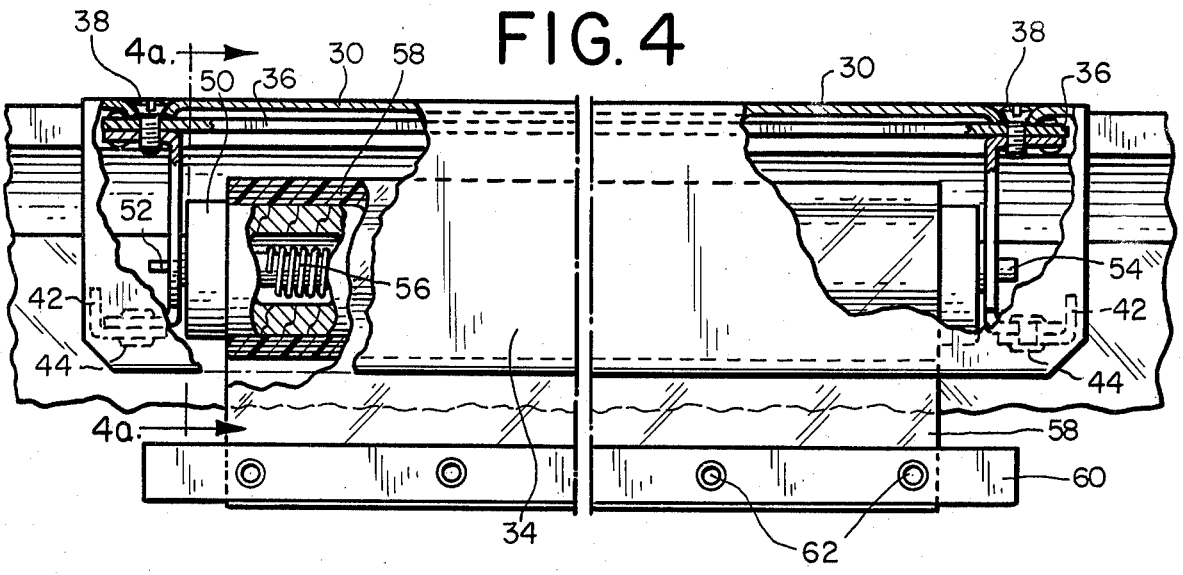
FIG. 4 is a cross-sectional view taken along line 4—4 of FIG. 3 showing the display sheet reversed to display the message shown in FIG. 2.

Referring now to the drawings, FIG. 1 shows a partial front view of a gasoline dispensing pump 10 on which is mounted a preferred embodiment of the present invention. This pump 10 includes a pump face which is surrounded by a frame 11 having an upper frame edge 12 and a lower frame edge 14. The pump face is covered by a pane of glass 16 which covers a left dispensing station display 18 and a right dispensing station display 20. This pump 10 is a standard pump which includes means for displaying price and quantity information related to two separate dispensing stations situated one on either side of the pump 10.

This preferred embodiment includes an upper bracket 30 which is shown in front view in FIG. 1 and in section in FIG. 3. This upper bracket 30 includes a recurved lip 32 sized to fit around the rear portion of the upper edge 12 of the frame 11. In this way the upper bracket 30 is securely mounted to the frame 11 in a manner such that it is free to slide along the upper edge 12 between a center position shown in FIG. 1, a right-hand position shown in FIG. 2, and a left-hand position (not shown). This upper bracket 30 includes a curved shade 34 which extends over and protects internal components of the sign. A roller bracket 36 is detachably secured to the upper bracket 30 by means of two fasteners 38. These fasteners are shown in FIGS. 3 and 4. Each side of the roller bracket 36 is provided with a cutout 40 and a locking arm 42 which is pivotably mounted to the roller bracket 36 by means of a fastener 44. Each locking bracket 42 is shaped and positioned to cooperate with the respective cutout 40 as will be explained below.

Mounted in the roller bracket 36 is a roller 50, which is provided with a rectangular end 52 at one end, which is secured to the roller bracket 36 in a nonrotatable manner, and a cylindrical end 54, which is secured to the other end of the roller bracket 36 in a rotatable manner. A spring 56 is provided within the roller 50 to bias the roller. As assembled, the roller 50 acts much as a conventional window shade roller without a ratchet mechanism.

Figure 4A:
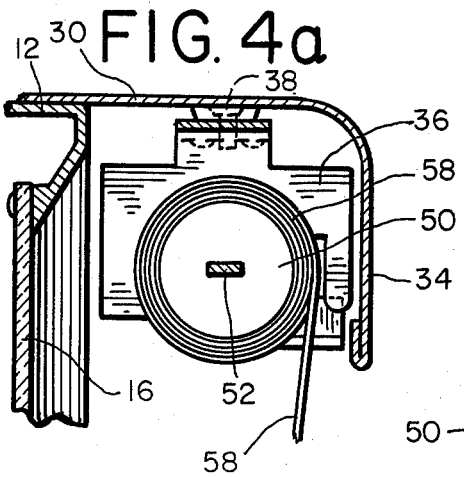
FIG. 4*a* is a cross-sectional view taken along line 4*a*—4*a* of FIG. 4.

Mounted on the roller 50 is a display sheet 58 which can be moved between a retracted position, in which the display sheet 58 is wound around the roller 50, and an extended position, in which the display sheet 58 extends across and substantially parallel to the pump face. The display sheet 58 bears a silk screened message on each side. As shown in FIGS. 1 and 2, separate messages can be placed on the two sides of the display sheet 58. By simply removing the fasteners 38 and turning the roller bracket 36 end for end, the roller 50 can be positioned such that either of the two sides of the display sheet 58 faces away from the pump face. FIGS. 3 and 3*a* show the roller positioned to display the message shown in FIG. 1, while FIGS. 4 and 4*a* show the roller 50 in the reversed position, in which the message shown in FIG. 2 is displayed.

Figure 6:
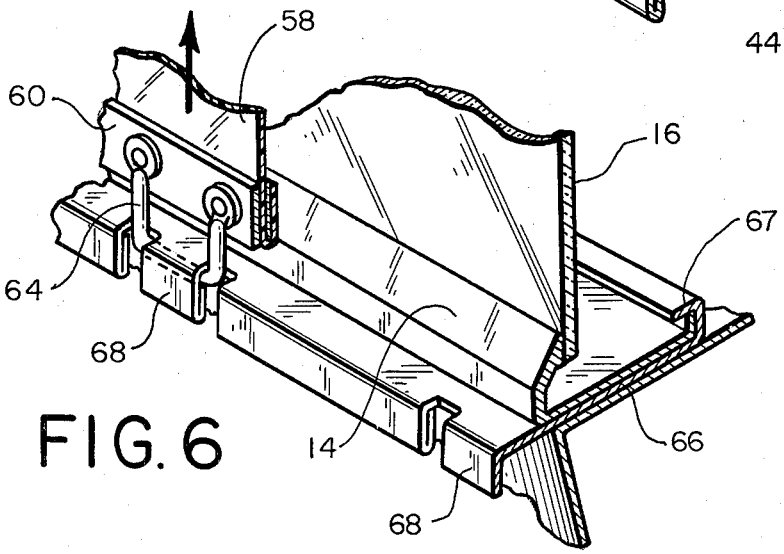
FIG. 6 is a partial perspective view in partial cutaway showing a lower portion of the display sign of FIG. 1.

A cross bar 60 is fastened to a lower edge of the display sheet 58 by means of fasteners 62. Preferably, the cross bar 60 is made up of two separate bars as shown in FIGS. 3 and 6. The display sheet 58 is passed between these two bars such that the fasteners 60 serve to compress the bars together and to hold the display sheet 58 firmly in place between the bars. A loop defining member 64 is attached to the central portion of the cross bar 60.

As best shown in FIGS. 3 and 6, this preferred embodiment also includes a lower bracket 66. This lower bracket 66 is provided with a recurved lip 67 which is sized to fit around a rear portion of the lower edge 14 of the frame 11. In this way the lower bracket 66 can be readily mounted to the pump 10. This lower bracket 66 includes three separate hook sections 68 which are spaced across the lower edge 14 of the frame 11 as shown in FIGS. 1 and 2. FIG. 6 shows a detail of this lower bracket 66 showing the manner in which any one of the hooks 68 can pass through the loop defining member 64 to hold the display sheet 58 in the extended position across the face of the pump 10. The spring bias of the roller 50 serves to maintain a tension on the display sheet 58 to prevent the loop defining member 64 from working free of the hooks 68.

Preferably, the upper bracket 30 and the lower bracket 66 are formed of annealed stainless steel to prevent rusting. The cross bar 60 can be advantageously made of aluminum, and the display sheet 58 of oriented polyester. The display sheet is inferably transparent with a silk screened message placed thereon. An important advantage of a display sheet which includes transparent portions is that parts of the pump face, such as those which identify the fuel, can be seen through display sheet. FIG. 2 shows a preferred arrangement of such transparent portions.

An important feature of this preferred embodiment is that it can be easily and simply moved across the face of the pump 10 to indicate that either one or both of the dispensing stations in the pump 10 is closed. FIG. 1 shows the upper bracket 30 positioned in the central position and the loop defining member 64 engaged with the center hook 68. In this position the display sheet 58 extends partially over both the left and the right dispensing station displays 18,20, effectively indicating that both dispensing stations are closed. FIG. 2 shows the same preferred embodiment shifted laterally across the face of the pump 10 to cover the right dispensing station display 20 only. As explained above, the upper bracket 30 slides along the upper edge 12 of the frame 11 to place the upper bracket 30 over the right hand portion of the pump face. In this position the loop defining member 64 is engaged with the right hand hook 68, thereby covering only the right dispensing station display 20 and indicating that only the right dispensing station is closed. Similarly, the upper bracket 30 can be moved to a left position (not shown) in which only the left dispensing station display 18 is covered.

A second feature of this preferred embodiment is that the roller 50 can be mounted in either of two orientations in the upper bracket 30 to display either side of the display sheet 58. In this way two separate messages can be simply provided such that the operator can easily select which of the two messages is to be displayed.

Figure 5:
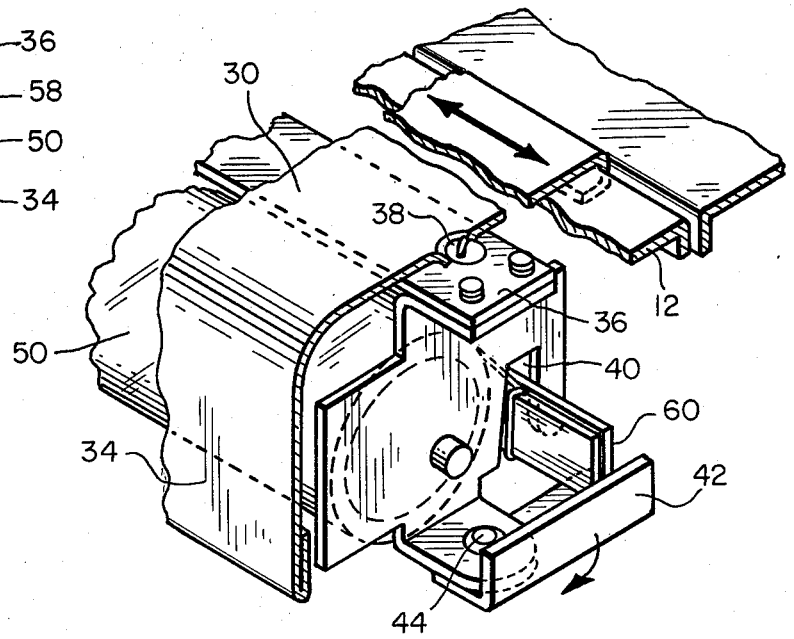
FIG. 5 is a partial perspective view in partial cutaway showing an end of the upper portion of the display sign of FIG. 1.

Another feature of this embodiment is that it provides a simple, effective means for locking the display sheet 58 in the retracted position. As best shown in FIGS. 3*a* and 5, when the display sheet 58 is retracted around the roller 50 by the spring 56 the cross bar 60 enters and is retained by the cutout 40. The locking arms 42 can then be pivoted about the fasteners 44 to retain the cross bar 60 in this position. When so locked, the display sheet is less subject to being pulled out and damaged by a passerby.

From the foregoing, it should be apparent that a versatile, compact, roll type display sign for a pump has been disclosed. This display sign offers the advantage of simultaneously covering the dispensing station display of the pump while it prominently displays an appropriate message. The sign can easily be moved between a retracted position in which the message is hidden from view, and an extended position in which the message is prominently displayed. Additionally, this preferred embodiment is readily movable across the face of the pump to indicate that either one or both of the dispensing stations of a dual station pump is out of service.

Of course, it should be understood that various changes and modifications to the preferred embodiment described above will be apparent to those skilled in the art. For example, the spring biased roller may be replaced by a self-coiling display sheet such as that disclosed in U.S. Pat. No. 3,426,115 (Taber). Alternately, embodiments of the invention can be adapted for use with other types of pump frames in conjunction with pumps of either the single or the dual dispensing station type. Such changes and modifications can be made without departing from the spirit and scope of the present invention, and it is therefore intended that such changes and modifications be covered by the following claims.

I claim:

1. A roll type display sign for a pump having a pump face, said sign comprising:

a message bearing display sheet;

means for mounting the display sheet to the pump such that the display sheet is movable across the pump face to a selected one of a plurality of mounting positions spaced across the pump face;

means for retracting the display sheet such that the display sheet is movable between an extended position, in which the sheet extends over a selected one of a plurality of portions of the pump face, and a retracted position, in which the sheet exposes the selected one of the plurality of portions of the pump face, each of the plurality of portions of the pump face corresponding to a respective one of the plurality of mounting positions; and means for releasably holding the display sheet in the extended position in any one of the plurality of mounting positions such that the display sheet simultaneously covers the portion of the pump face corresponding to the selected one of the mounting positions and displays the message on the display sheet.

2. The invention of claim 1 wherein the holding means includes a hook member and a plurality of aperture defining members sized to fit around the hook member.

3. The invention of claim 1 further including means for spring biasing the display sheet into the retracted position.

4. The invention of claim 1 further including means for locking the display sheet in the retracted position.

5. The invention of claim 1 wherein the display sheet bears a different message on each side.

6. A display sign for a pump having a pump face and a frame surrounding the pump face, said sign comprising:

a first bracket adapted for mounting to a first edge of the frame such that the first bracket is slideable along the frame;

a roller rotatably mounted to the first bracket such that the roller is substantially parallel to the first edge of the frame when the bracket is mounted to the frame;

a display sheet having a first edge affixed to the roller;

means for spring biasing the display sheet into a retracted position in which the display sheet is wrapped around the roller;

an attachment structure affixed to a second edge of the display sheet, opposed to the first edge of the display sheet;

a second bracket adapted for mounting to a second edge of the frame, opposed to the first edge of the frame, said second bracket including at least first and second spaced means for securing the attachment structure to the second bracket;

said first bracket slideable between a first position, in which the display sheet when extended covers a first portion of the pump face and the attachment structure is aligned with the first securing means, and a second position, in which the display sheet when extended covers a second portion of the pump face and the attachment structure is aligned with the second securing means.

7. The display sign of claim 6 wherein the display sheet bears a first display message on the first side of the sheet and a second display message on the second side of the sheet, and the roller is reversably mounted to the first bracket such that either the first or second display message can be oriented to face away from the pump face when the display sheet is extended.

8. The display sign of claim 6 further including third means for securing the attachment structure to the second bracket.

9. The display sign of claim 6 wherein the attachment structure includes an aperture defining member and each of the first and second securing means includes a hook member sized to fit within and hold the aperture defining member.

10. The display sign of claim 6 further including means for locking the display sheet in the retracted position.

11. A roll type display for a pump having a pump face and a frame surrounding the pump face, said display comprising:

an upper bracket having a recurved lip sized to fit around an upper edge of the frame such that the upper bracket is slideable along the frame between a left position, a center position, and a right position;

a roller mounted to the upper bracket;

a message bearing display sheet having a first edge secured to the roller and a second edge, opposed to the first edge;

a cross bar secured to the second edge of the display sheet;

a loop defining member secured to the cross bar;

means for spring biasing the roller to wind the display sheet around the roller such that the display sheet is biased towards a retracted position with the cross bar adjacent the roller;

a lower bracket adapted for mounting to a lower edge of the frame, said lower bracket defining three hooked projections spaced laterally across the lower edge of the frame when the lower bracket is mounted to the frame, said three hooked projections positioned to fit within the loop defining member when the upper bracket is positioned in the left, center and right positions, respectively, such that the display sheet can be positioned to cover any one of three distinct portions of the pump face.

12. The invention of claim 11 further including means for locking the cross bar adjacent the roller.

13. The invention of claim 11 wherein the display sheet bears a first message on the first side of the sheet and a second message on the second side of the sheet, and the roller is reversably mounted to the upper bracket such that either the first or second message can be oriented to face away from the pump face when the display sheet is extended.

* * * * *